US008161917B2

(12) United States Patent
Yang et al.

(10) Patent No.: US 8,161,917 B2
(45) Date of Patent: Apr. 24, 2012

(54) LOW BED PRESSURE DROP CIRCULATING FLUIDIZED BED BOILER AND COMBUSTION PROCESS

(75) Inventors: Hairui Yang, Beijing (CN); Hai Zhang, Beijing (CN); Guangxi Yue, Beijing (CN); Junfu Lv, Beijing (CN); Qing Liu, Beijing (CN); Jiansheng Zhang, Beijing (CN)

(73) Assignee: Tsinghua University, Haidian District, Beijing (CN)

( * ) Notice: Subject to any disclaimer, the term of this patent is extended or adjusted under 35 U.S.C. 154(b) by 842 days.

(21) Appl. No.: 12/264,222

(22) Filed: Nov. 3, 2008

(65) Prior Publication Data

US 2009/0120384 A1 May 14, 2009

(51) Int. Cl.
*F23C 10/01* (2006.01)

(52) U.S. Cl. ..... 122/4 D; 432/58; 165/104.16

(58) Field of Classification Search ..... 122/4 D; 165/104.16; 432/15, 16, 58
See application file for complete search history.

(56) References Cited

U.S. PATENT DOCUMENTS

| | | | | | |
|---|---|---|---|---|---|
| 3,775,040 | A * | 11/1973 | Vollans | 432/15 |
| 4,165,717 | A | 8/1979 | Reh et al. | |
| 4,686,939 | A * | 8/1987 | Stromberg | 122/4 D |
| 4,809,625 | A * | 3/1989 | Garcia-Mallol et al. | 110/347 |
| 4,896,631 | A * | 1/1990 | Holm et al. | 122/4 D |
| 5,054,436 | A * | 10/1991 | Dietz | 122/4 D |
| 5,269,263 | A * | 12/1993 | Garcia-Mallol | 122/4 D |
| 6,264,465 | B1 * | 7/2001 | Ishida | 432/58 |
| 7,549,859 | B2 * | 6/2009 | Dupuis | 432/58 |
| 8,069,825 | B1 * | 12/2011 | Higgins | 122/4 D |
| 2009/0314226 | A1 * | 12/2009 | Higgins | 122/4 D |

* cited by examiner

*Primary Examiner* — Gregory A Wilson
(74) *Attorney, Agent, or Firm* — Raj Abhyanker, P.C.

(57) ABSTRACT

A method, system and apparatus for a low bed pressure drop circulating fluidized bed (CFB) boiler associated with fast bed CFB combustion are disclosed. The CFB boiler may be operated according to the following set of conditions. In an upper area of a combustor of the boiler, a flow pattern of the two-phase gas-solid flow may be placed in a fast bed fluidization state. The combustor temperature may be within a range of 850° C.-930° C. The fluidizing air velocity may be within 4 m/s and 6.2 m/s. An average size of a bed material in the combustor may be smaller than 300 μm. The gas-solid flow above of the secondary air inlet in the combustor may be kept in the fast bed fluidization state while maintaining a solid concentration of between 1 kg/m3 to 5 kg/m3. An inventory of bed material per unit area and/or the pressure drop in the combustor may be less than 8 kPa.

20 Claims, 4 Drawing Sheets

CFB BOILER WITH HEAT EXCHANGE 250

AXIAL PROFILES VIEW 350

LOW BED PRESSURE DROP CIRCULATING FLUIDIZED BED BOILER AND COMBUSTION PROCESS

CLAIM OF PRIORITY

This application claims priority from a P.R. China convention country patent application Number 200710176731.1 filed on Nov. 2, 2007.

FIELD OF TECHNOLOGY

This disclosure relates generally to a circulating fluidized bed (CFB) combustion technology and equipment, in particular, a low bed pressure drop CFB boiler and/or combustion process.

BACKGROUND

A power plant may use a circulating fluidized bed (CFB) combustion technology (e.g. a type of steam generator that uses a type of fluidized bed combustion). The CFB boiler may circulate a fluidized bed material in such a way that it is separated from a cloud of flue gases by a cyclone. The fluidized bed material may be returned via a return duct back to a furnace (e.g. heating device) of a boiler (e.g. vessel in which a fluid is heated). A primary air fan may be used to control the fluidized bed material. A pressure head of the primary air fan may equal a sum of a set of pressure drops of a combustor, a distributor, a set of air ducts and a set of air preheaters. The primary air fan may consume additional power to counter the sum of the set of pressure drops. Additionally, an amount of bed material inventory may require a secondary air to achieve a specified level of momentum in order to penetrate into a center zone of the combustor. Consequently, an other pressure head of a secondary air fan will also consume additional power. Together, an increase of power consumption by the primary air fan and the secondary air fan may increase a self-used power consumption value of the CFB boiler.

Moreover, a certain amount of bed material may cause a height level of a dense bed to increase. This effect may cause a quantity of coarse particles to entrain in the middle height section of the combustor. The quantity of coarse particles may then fall down to the dense bed. Thus an amount of bed material may increase. In turn, an average value of solid concentration may increase. A greater average value of solid concentration may hamper an operational level of the combustor. Consequently, combustion efficiency of the CFB boiler may decrease.

SUMMARY

A method, system, and apparatus for a low bed pressure drop CFB boiler and/or combustion process are disclosed. In one embodiment, a method may provide a new low bed pressure drop combustion process. This particular process may reduce the bed inventory per unit area and thereby reduce the solid concentration in the upper combustor. The method may also maintain a fast bed fluidization process (e.g. a process similar to liquefaction whereby a granular material is converted from a static solid-like state to a dynamic fluid-like state) in the CFB. This fast bed fluidization process may occur when a fluid (e.g. liquid and/or gas) is passed up through a granular material in the upper combustor (e.g. a component of a gas turbine, ramjet and/or a pulsejet engine where combustion takes place).

One embodiment may include a low bed pressure drop combustion process for a CFB boiler. The CFB boiler may be operated according to the following set of conditions. In an upper area of a combustor of the boiler, a flow pattern of the two-phase gas-solid flow may be placed in a fast bed fluidization state. The CFB combustor temperature may be within a range of 850° C.-930° C. The fluidizing air velocity may be within 4 m/s and 6.2 m/s. An average size of a bed material in the CFB combustor may be smaller than 300 μm. The gas-solid flow above of the secondary air inlet in the CFB combustor may be kept in the fast bed fluidization state while maintaining a solid concentration of between 1 kg/m3 to 5 kg/m3. An inventory of bed material per unit area and/or the pressure drop in the CFB combustor may be less than 8 kPa.

According to one embodiment, the pressure drop of the CFB combustor may be calculated according to the following equation:

$$(N1+K0+0.07\times h)>P>(N2+K0+0.02\times h)$$

P may stand for a value of a pressure drop of the bed. P may be measured in kPa standard units. The symbol 'h' may stand for a CFB combustor height in meters. N1 may be an upper limit for the height of CFB combustor burning a particular coal type. In particular, for anthracite, N1 may be 3.5 m; for bituminous, N1 may be 2.5 m; and for lignite, N1 may be 2.0 m. N2 may be a lower limit for the CFB combustor burning the particular coal type. In particular, for anthracite N2 may be 1.5 m, for bituminous N2 may be 1.3 m, and for lignite N2 may be 1.2 m. K0 may be a constant value for a particular type of dense bed component. In this particular embodiment, K0 may be 1.5.

According to the embodiment, the CFB process may be implemented with a low bed pressure drop CFB boiler. The CFB boiler may comprise of a CFB combustor for combustion. The CFB boiler may further include a cyclone (e.g. a high speed rotating (air) flow is established within a cylindrical or conical container) used to separate the solid material entrained by the fluidizing air. The CFB may include a back-feeding valve. The back-feeding valve may transfer a solid material back into a furnace. The CFB may include a secondary air injecting port. The secondary air injecting port may be connected at lower part of the CFB combustor. Secondary air injecting port may be connected to a secondary air fan and/or a primary air inlet. The primary air inlet may be connected to the primary air fan below the furnace.

The embodiment may decrease the power consumption of the primary air fan. The embodiment may also significantly reduce the power consumption of the secondary air fan. Reducing the power consumption of the auxiliary devices may increase the energy-saving combustion of the CFB boilers. In addition, the gaseous mixing of the CFB boiler may be improved due to the reduction of the solid concentration in the combustion space. This may result in a potential increment of combustion efficiency. The height of the dense bed may be reduced. The reduction may reduce a certain number of particles elutriated and/or entrained to the upper CFB combustor. The reduction of a certain number of particles may result in a less intense erosion of a water wall membrane heating surface.

BRIEF DESCRIPTION OF THE FIGURES

Example embodiments are illustrated by way of example and not limitation in the figures of the accompanying drawings, in which like references indicate similar elements and in which.

Other features of the present embodiments will be apparent from the accompanying drawings and from the detailed description that follows.

DETAILED DESCRIPTION

A method, apparatus, and system of a low bed pressure drop CFB boiler and/or combustion process are disclosed. Although the present embodiments have been described with reference to specific example embodiments, it will be evident that various modifications and changes may be made to these embodiments without departing from the broader spirit and scope of the various embodiments.

Figure 1:
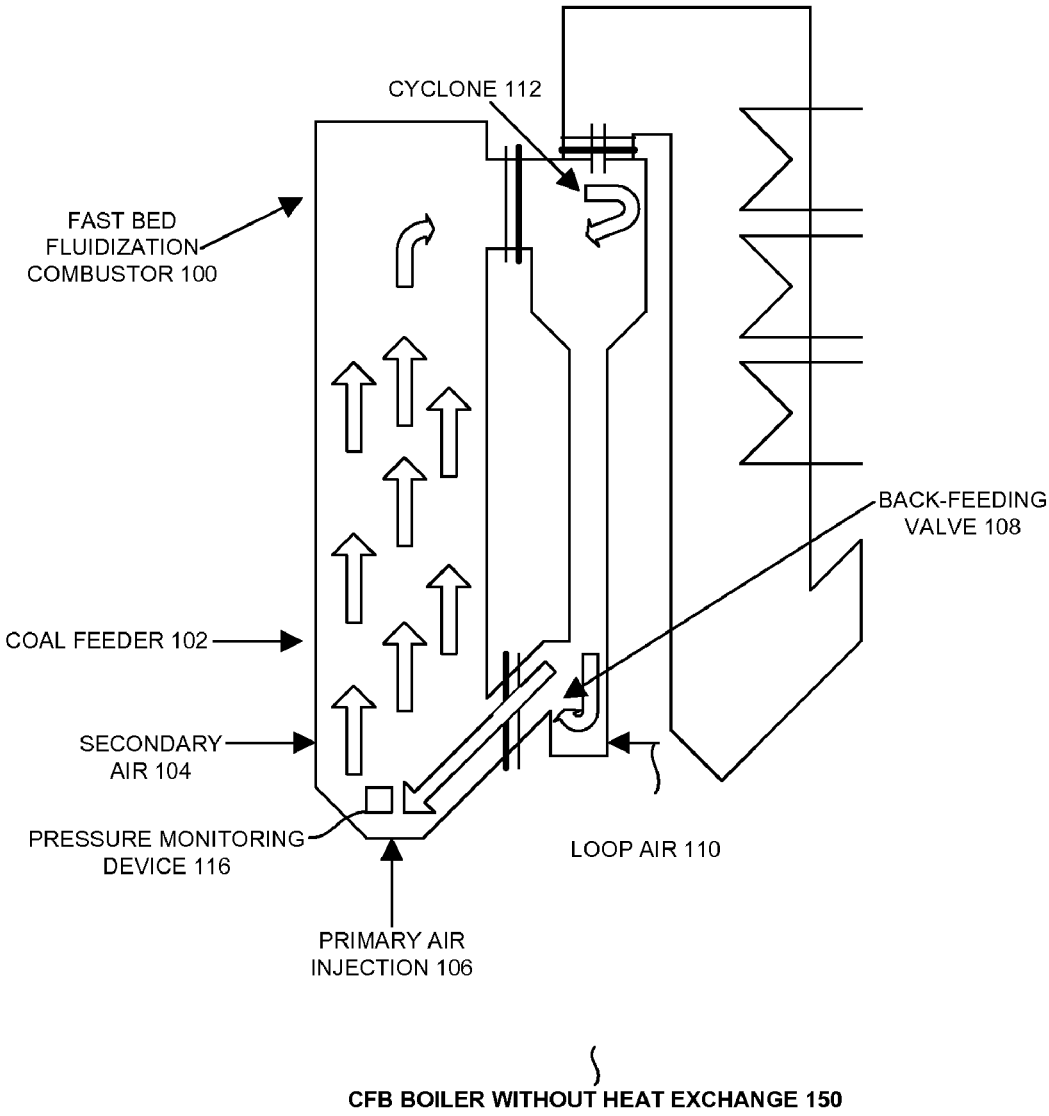
FIG. 1 shows the schematic structure of a circulating fluidized bed boiler without external heat exchangers according to one embodiment.

FIG. 1 shows a structure of a CFB boiler without an external heat exchanger 150, according to an embodiment. As shown in the figure, the CFB boiler may include a fast bed fluidization combustor 100, a coal feeder 102, a secondary air injection 104, a primary air injection 106, a cyclone 112, a back-feeding valve 108, and a loop air injection 110. The secondary air injection 104 may be located at the lower part of the fast bed fluidization combustor 100 to serve as a secondary air source. The primary air injection 106 may be located below the fast bed fluidization combustor to provide a primary air source. The cyclone 112 may be used for separating the solid materials entrained by the fluidizing air. The loop air injection 110 may be located at the bottom of the back-feeding valve 108. The CFB boiler may include a pressure monitoring device 116 to manage a pressure value of the CFB boiler.

The bed materials inside the fast bed fluidization combustor may be fluidized by the fluidizing gas flow from a fast bed. Combustion may occur in the fast bed fluidization combustor at a temperature within the range of 850° C. to 930° C. Limestone may be used for desulphurization when sulfur-contained fuels are burnt. Part bed materials are entrained by the flue gas into the separators. An amount of part bed material may be collected and returned through a control valve to the fast bed fluidization combustor 100. The collection of the part bed material may aid in maintaining a balance of a number of materials. This may aid in maintaining the bed in fast fluidization region. The back-feeding valve 108 may transfer the separated solid material back into the fast bed fluidization combustor 100.

Figure 2:
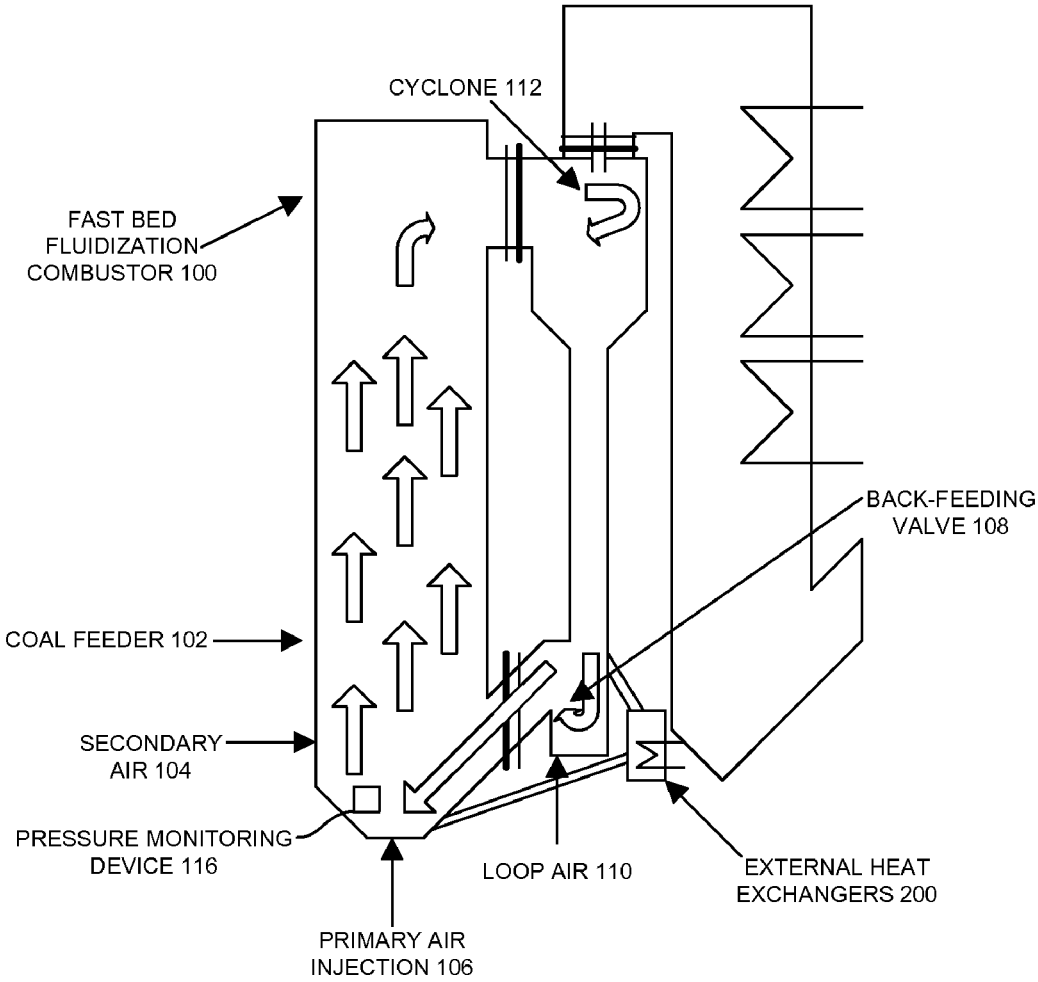
FIG. 2 shows the schematic structure of a circulating fluidized bed boiler with external heat exchangers according to one embodiment.

FIG. 2 shows schematic structure of a particular embodiment. The particular embodiment of the CFB boiler may have a number of external heat exchangers 250. As shown in FIG. 2, the boiler also equips external heat exchangers 200 to cool the solids material separated by a cyclone.

Another embodiment may include a combustion process for operating CFB boilers at a low bed pressure drop. The fast bed fluidization combustor 100 may be maintained in a fast bed fluidization state. In an upper area of the fast bed fluidization combustor 100 of the boiler, a flow pattern of the two-phase gas-solid flow may be placed in a fast bed fluidization state. The fast bed fluidization combustor temperature may be within a range of 850° C.-930° C. The fluidizing air velocity may be within 4 m/s and 6.2 m/s. An average size of a bed material in the fast bed fluidization combustor 100 may be smaller than 300 μm. The gas-solid flow above of the secondary air injection 104 in the fast bed fluidization combustor 100 may be kept in the fast bed fluidization state while maintaining a solid concentration of between 1 kg/m3 to 5 kg/m3. An inventory of an amount of bed material per unit area and/or the pressure drop in the fast bed fluidization combustor 100 may be less than 8 kPa.

Figure 3:
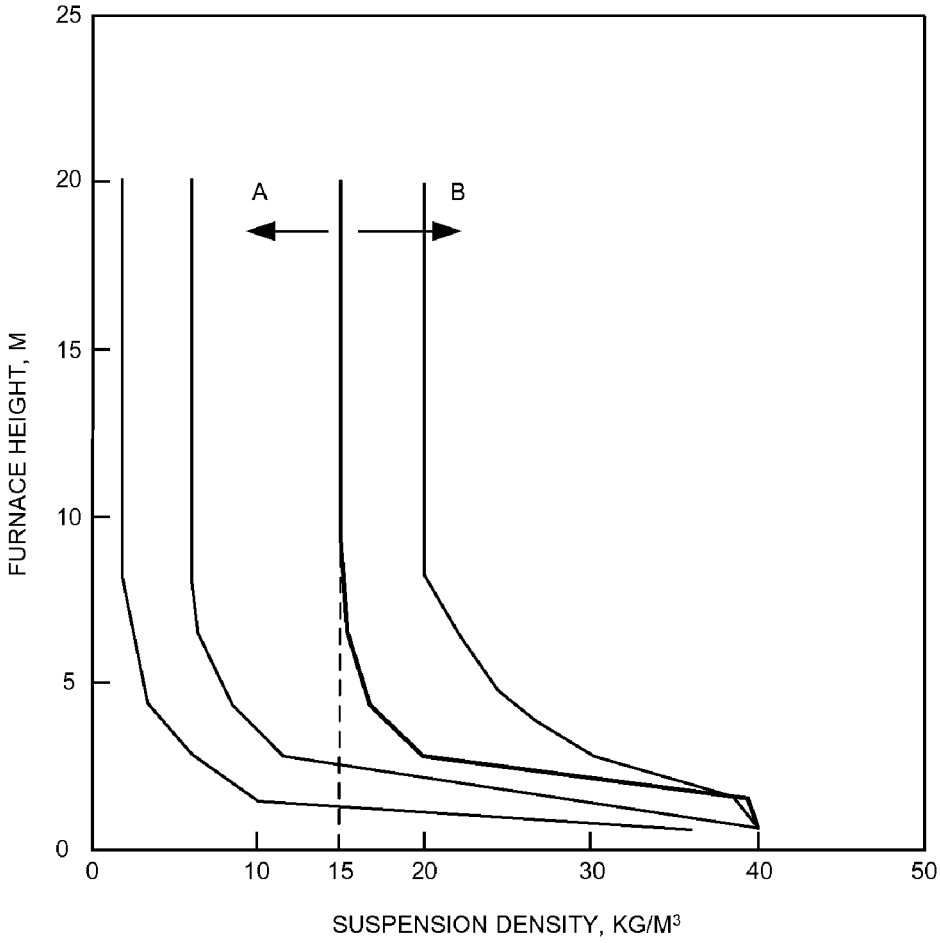
FIG. 3 shows atypical axial profiles of solid concentration in a fast bed according to one embodiment.

FIG. 3 shows the typical axial profiles of solid concentration in a fast bed. For different bed material inventory, the solid concentrations above of the secondary air injection 104 are different, forming a group of exponential curves. For the conventional CFB boiler technologies, the solid concentration may be above 15 kg/m$^3$. For this embodiment, the solid concentration may be between 1 kg/m$^3$ and 15 kg/m$^3$. In FIG. 2, Zone A is for this embodiment and Zone B is for the conventional technologies.

Another embodiment may utilize a specified equation to control a pressure drop of the CFP boiler. Controlling the pressure drop may be used realize a specified solid concentration profile and/or maintain the inventory of bed material per unit area or the pressure drop in the CFB combustor at less than 8 kPa. According to the other embodiment, the pressure drop of the fast bed fluidization combustor 100 may be calculated according to the following equation:

$$(N1+K0+0.07\times h)>P>(N2+K0+0.02\times h)$$

P may stand for a value of a pressure drop of the bed. P may be measured in kPa standard units. The symbol 'h' may stand for the fast bed fluidization combustor height in meters. N1 may be an upper limit for the height of fast bed fluidization combustor 100 burning a particular coal type. In particular, for anthracite, N1 may be 3.5 m; for bituminous, N1 may be 2.5 m; and for lignite, N1 may be 2.0 m. N2 may be a lower limit for the fast bed fluidization combustor burning the particular coal type. In particular, for anthracite N2 may be 1.5 m, for bituminous N2 may be 1.3 m, and for lignite N2 may be 1.2 m. The symbol $K_0$ may be a constant value for a particular type of dense bed component. In this particular embodiment, $K_0$ may be 1.5. The pressure monitoring device 116 may automatically manage the pressure drop of the CFB boiler according the equation (e.g. another specified equation and/or the equation $(N1+K_0+0.07\times h)>P>(N2+K_0+0.02\times h)$). In an another alternative embodiment, a CFB operator may use the equation to manually manage the pressure drop of the CFB boiler.

In an example of an embodiment, a CFB boiler may burn anthracite coal. A CFB designer may have designed the fast bed fluidization combustor 100 to be 30 m in height. A CFB operator may maintain the solid concentration in the fast bed fluidization combustor 100 above the secondary air inlet at a value between 3 kg/m$^3$-5 kg/m$^3$. The CFB operator may maintain the combustion temperature inside the fast bed fluidization combustor 100 between 850° C.-930° C. The CFB designer may have designed the size of input fuel as between 0.0 mm and 8.0 mm. The CFB operator may use the equation, $(N1+K_0+0.07\times h)>P>(N2+K_0+0.02\times h)$ to ensure the pressure drop is between 3.6 kPa and 7.1 kPa.

Figure 4:
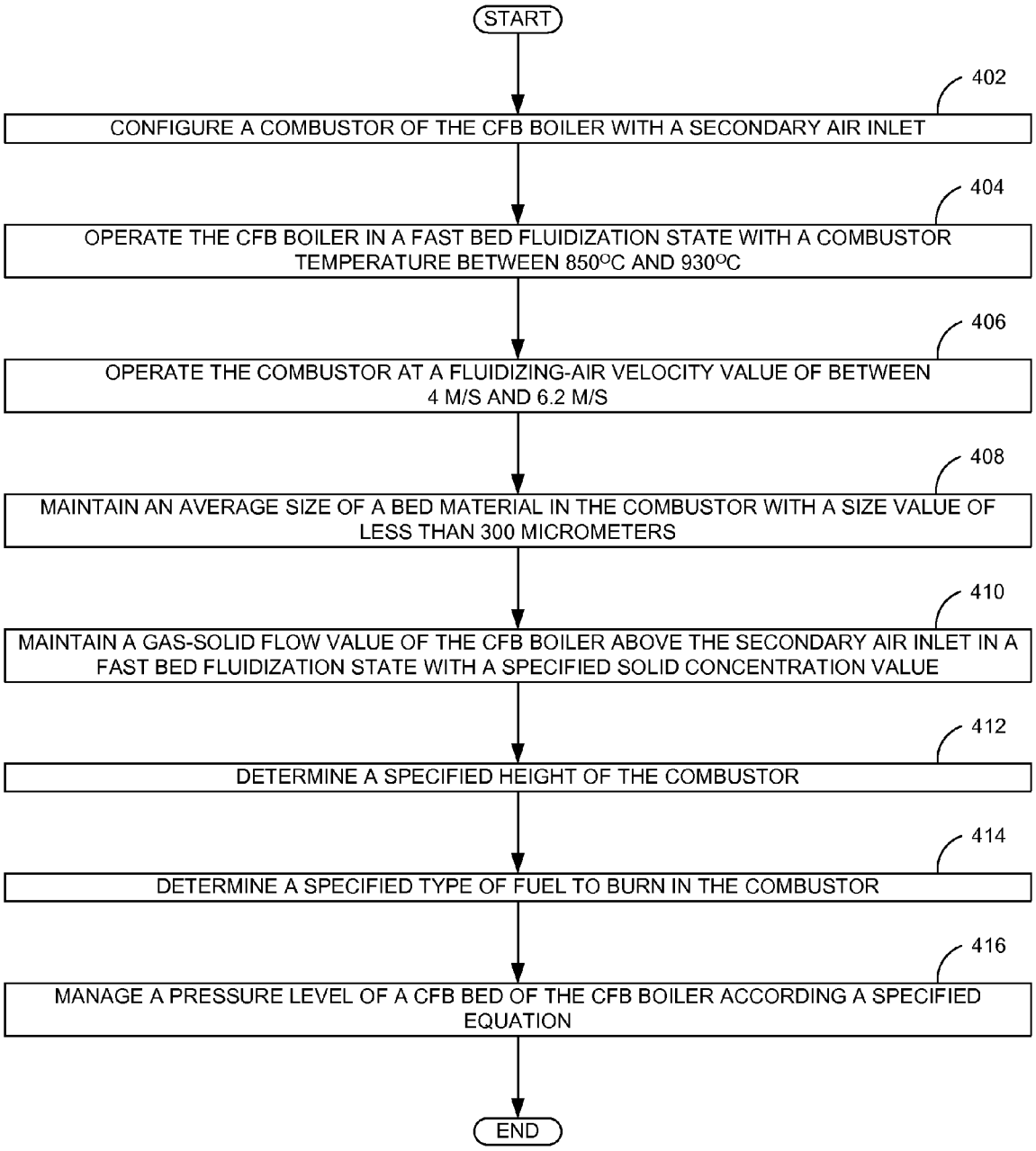
FIG. 4 is a process flow of managing a pressure level of a cfb bed of the cfb boiler according to one embodiment.

FIG. 4 is a process flow of managing a pressure level of a CFB bed of the CFB boiler according to one embodiment. In operation 402, a combustor of the CFB boiler may be configured with a secondary air inlet (e.g., the secondary air injection 104). In operation 404, the CFB boiler may be operated in a fast bed fluidization state with a combustor temperature between 850° C. and 930° C. In operation 406, the CFB combustor may be operated at a fluidizing-air velocity value of between 4 m/s and 6.2 m/s. In operation 408, an average size of a bed material may be maintained in the CFB combustor with a size value of less than 300 micrometers.

In operation 410, a gas-solid flow valve of the CFB boiler may be maintained above the secondary air inlet in a fast bed fluidization state with a specified solid concentration value. The specified solid concentration value may be between 1 $kg/m^3$ to 15 $kg/m^3$. A value of a bed material per unit area of the CFB combustor may be of a specified value of at least one of equal to 8 k/Pa and less than 8 k/Pa. A pressure drop value of the CFB combustor may be of a specified pressure drop value of equal to 8 k/Pa and/or less than 8 k/Pa. The secondary air inlet may be located at a lower part of the combustor and connected to a secondary air fan.

In operation 412, a specified height of the CFB combustor may be determined. The specified height value of the CFB combustor may be used to control the specified pressure drop value of the CFB combustor. The CFB boiler may be equipped with an external heat exchanger to cool a solid material separated by a cyclone (e.g., the cyclone 112 of FIG. 2) associated with the CFB combustor. In operation 414, a specified type of fuel may be determined to burn in the CFB combustor. The cyclone 112 may be generated by the CFB boiler and used to separate the solid material entrained by a fluidizing air. The specified type of fuel may be an anthracite coal fuel and the specified height value of the CFB combustor is between 1.5 meters and 3.5 meters.

The specified type of fuel may be a bituminous coal fuel and the specified height value of the CFB combustor may be between 1.3 meters and 2.5 meters. The specified type of fuel is a lignite coal fuel and the specified height value of the CFB combustor may be between 1.2 meters and 2.0 meters. In operation 416, a pressure level of a CFB bed of the CFB boiler may be managed according a specified equation. The specified equation may be $(N1+K0+0.07\times h)>P>(N2+K0+0.02\times h)$. 'P' is a value of a pressure drop of the bed. 'h' is a CFB combustor height. 'N1' is an upper height limit of the CFB combustor burning a particular coal type. 'N2' is a lower height limit of the CFB combustor burning the particular coal type. 'K0' is a constant value associated with a specified type of a dense bed component.

Although the present embodiments have been described with reference to specific example embodiments, it will be evident that various modifications and changes may be made to these embodiments without departing from the broader spirit and scope of the various embodiments. For example, the various devices, modules, analyzers, generators, etc. described herein may be enabled and operated using hardware circuitry (e.g., CMOS based logic circuitry), firmware, software and/or any combination of hardware, firmware, and/or software (e.g., embodied in a machine readable medium). For example, the various electrical structure and methods may be embodied using transistors, logic gates, and electrical circuits (e.g., application specific integrated (ASIC) circuitry and/or in Digital Signal Processor (DSP) circuitry). Particularly, the various modules may be enabled using circuits.

In addition, it will be appreciated that the various operations, processes, and methods disclosed herein may be embodied in a machine-readable medium and/or a machine accessible medium compatible with a data processing system (e.g., a computer system), and may be performed in any order (e.g., including using means for achieving the various operations). Accordingly, the specification and drawings are to be regarded in an illustrative rather than a restrictive sense.

What is claimed is:

1. A method of operating a circulating fluidized bed (CFB) boiler comprising:

configuring a combustor of the CFB boiler with a secondary air inlet;

operating the CFB boiler in a fast bed fluidization state with a combustor temperature between 850° C. and 930° C.;

operating the combustor at a fluidizing-air velocity value of between 4 m/s and 6.2 m/s;

maintaining an average size of a bed material in the combustor with a size value of less than 300 micrometers; and maintaining a gas-solid flow value of the CFB boiler above the secondary air inlet in a fast bed fluidization state with a specified solid concentration value.

2. The method of claim 1 wherein the specified solid concentration value is between 1 kg/m3 to 15 kg/m3.

3. The method of claim 2 wherein a value of a bed material per unit area of the combustor is of a specified value of at least one of equal to 8 k/Pa and less than 8 k/Pa.

4. The method of claim 2:

wherein a pressure drop value of the combustor is of a specified pressure drop value of at least one of equal to 8 k/Pa and less than 8 k/Pa;

wherein the secondary air inlet is located at a lower part of the combustor and connected to a secondary air fan.

5. The method of claim 4:

further comprising determining a specified height of the combustor;

wherein the specified height value of the combustor is used to control the specified pressure drop value of the combustor; and wherein the CFB boiler is equipped with an external heat exchanger to cool a solid material separated by a cyclone associated with the combustor.

6. The method of claim 5:

further comprising determining a specified type of fuel to burn in the combustor;

wherein the cyclone is generated by the CFB boiler and used to separate the solid material entrained by a fluidizing air.

7. The method of claim 6 wherein the specified type of fuel is an anthracite coal fuel and the specified height value of the combustor is between 1.5 meters and 3.5 meters.

8. The method of claim 6 wherein the specified type of fuel is a bituminous coal fuel and the specified height value of the combustor is between 1.3 meters and 2.5 meters.

9. The method of claim 6 wherein the specified type of fuel is a lignite coal fuel and the specified height value of the combustor is between 1.2 meters and 2.0 meters.

10. The method of claim 6:

further comprising managing a pressure level of a CFB bed of the CFB boiler according a specified equation;

wherein the specified equation is $(N1+K0+0.07\times h)>P>(N2+K0+0.02\times h)$;

wherein P is a value of a pressure drop of the bed;

wherein h is a combustor height;

wherein N1 is an upper height limit of the combustor burning a particular coal type;

wherein N2 is a lower height limit of the combustor burning the particular coal type; and wherein K0 is a constant value associated with a specified type of a dense bed component.

11. A system of a circulating fluidized bed (CFB) boiler comprising:

a combustor to contain and control a burning fuel-air mixture;

a coal feeder to provide a specified type of fuel;

a secondary air inlet to provide a secondary air source;

a primary air injection to provide a primary air source;

a cyclone to separate solid materials entrained by the fluidizing air;

a back-feeding valve to transfer a solid material back into the combustor; and a pressure monitoring device to manage a pressure value of the CFB boiler according to specified set of operating parameters and wherein the CFB boiler is maintained in a fast bed fluidization state with a combustor temperature between 850° C. and 930° C. and wherein the combustor is maintained at a fluidizing-air velocity value of between 4 m/s and 6.2 m/s and wherein an average size of a bed material in the combustor is maintained with a size value of less than 300 micrometers and wherein an average size of a bed material in the combustor with a size value of less than 300 micrometers.

12. The method of claim 11 wherein the pressure monitoring device maintains a gas-solid flow value of the CFB boiler above the secondary air inlet with a specified solid concentration value of between 1 kg/m3 to 15 kg/m3.

13. The system of claim 12 wherein the specified type of fuel is a specified type of coal; and wherein a pressure drop value of the combustor is of a specified pressure drop value of at least one of equal to 8 k/Pa and less than 8 k/Pa.

14. The system of claim 13:

wherein the secondary air inlet is located at a lower part of the combustor and connected to a secondary air fan;

wherein the primary air injection is located below the combustor; and wherein a loop air injection is located at the bottom of the back-feeding valve.

15. The system of claim 14 wherein the specified height value of the combustor is used to control the specified pressure drop value of the combustor.

16. The system of claim 15 wherein the specified type of coal is at least one of anthracite, bituminous and lignite.

17. The system of claim 16 wherein the pressure monitoring device manages a pressure level of a CFB bed according a specified equation.

18. The system of claim 17:

wherein the specified equation is $(N1+K0+0.07\times h)>P>(N2+K0+0.02\times h)$;

wherein P is a value of a pressure drop of the CFB bed;

wherein h is a combustor height;

wherein N1 is an upper height limit of the combustor burning a particular coal type;

wherein N2 is a lower height limit of the combustor burning the particular coal type; and wherein K0 is a constant value associated with a specified type of a dense bed component.

19. The system of claim 18:

wherein a height value of the combustor is between 1.5 meters and 3.5 meters if the specified type of coal is an anthracite coal fuel;

wherein the height value of the combustor is between 1.3 meters and 2.5 meters if the specified type of coal is a bituminous coal fuel; and wherein the height value of the combustor is between 1.2 meters and 2.0 meters if the specified type of coal is a lignite coal fuel.

20. The system of claim 19 wherein the CFB boiler is equipped with an external heat exchanger to cool a solid material separated by the cyclone associated with the combustor.

* * * * *